US007391376B2

(12) United States Patent
Yeh et al.

(10) Patent No.: US 7,391,376 B2
(45) Date of Patent: Jun. 24, 2008

(54) WIRELESS APPARATUS CAPABLE OF CONTROLLING RADIATION PATTERNS OF ANTENNA

(75) Inventors: Shih-Huang Yeh, Tou-Liu (TW); Zih-Hao Lu, Taichung Hsien (TW); Chia-Lun Tang, Miao-Li Hsien (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 11/762,763

(22) Filed: Jun. 13, 2007

(65) Prior Publication Data

US 2007/0236401 A1 Oct. 11, 2007

Related U.S. Application Data

(62) Division of application No. 11/221,148, filed on Sep. 7, 2005, now Pat. No. 7,352,327.

(30) Foreign Application Priority Data

May 5, 2005 (TW) ..... 94114506 A

(51) Int. Cl.
*H01Q 1/24* (2006.01)

(52) U.S. Cl. ..... 343/700 MS; 343/846

(58) Field of Classification Search ..... 343/700 MS, 343/702, 767, 829, 846
See application file for complete search history.

(56) References Cited

U.S. PATENT DOCUMENTS

| | | | | |
|---|---|---|---|---|
| 5,402,132 | A * | 3/1995 | Hall et al. | 342/432 |
| 7,002,527 | B2 * | 2/2006 | Sugawara | 343/750 |
| 2004/0217916 | A1 * | 11/2004 | Quintero Illera et al. | 343/895 |
| 2005/0259013 | A1 * | 11/2005 | Gala Gala et al. | 343/702 |
| 2005/0275591 | A1 * | 12/2005 | King et al. | 343/700 MS |

* cited by examiner

*Primary Examiner*—Tho G Phan

(57) ABSTRACT

A wireless apparatus capable of controlling radiation patterns and directions of antenna is provided. It comprises an antenna element, a ground plane, an antenna feed-point, and at least one slot or slit formed on the ground plane. The inclusion of such slots or slits in the wireless apparatus improves the radiation directivity of antenna, and greatly enhances the antenna gain on the horizontal plane. It also resolves the problems caused by shift of radiation patterns of antenna and the poor antenna gains for a conventional antenna apparatus. The wireless apparatus of the present invention has the advantages of simple structure and easy fabrication. The invention can be applied to various kinds of antennas, such as monopole antenna, shorted-monopole antenna, dipole antenna, loop antenna, and planar inverted-F antenna, etc.

3 Claims, 9 Drawing Sheets

WIRELESS APPARATUS CAPABLE OF CONTROLLING RADIATION PATTERNS OF ANTENNA

CROSS-REFERENCES TO RELATED APPLICATIONS

This is a division of U.S. patent application Ser. No. 11/221,148, filed Sep. 7, 2005 now U.S. Pat. No. 7,352,327.

FIELD OF THE INVENTION

The present invention generally relates to a wireless apparatus, especially to a wireless apparatus capable of controlling radiation patterns of antenna.

BACKGROUND OF THE INVENTION

As the applications of wireless apparatus grow, the radiation patterns of antenna become more and more important in order to improve the communication quality. The antenna of conventional wireless apparatus is usually placed near the edge of the wireless apparatus to reduce the size of the whole system. Therefore, the ground plane is not symmetrical to the antenna. The radiation patterns of antenna are affected by the ground plane. When the antenna is placed near the edge of the wireless apparatus, the radiation angle θ with maximum radiation energy of antenna is normally located at θ>90°. This means that the direction of maximum radiation energy is inclined to the ground plane. The shift of maximum radiation direction due to the above mentioned unsymmetrical ground plane is towards the human body, and the human body can absorb the radiation energy. This absorption of the radiation energy then degrades the quality of communication. A novel design for controlling the direction of the radiation patterns of antenna is necessary to improve the quality of communication.

In US Patent Publication US 2004/0252056 A1 "U-Shaped Multi-Frequency Antenna of High-Efficiency", a multi-frequency antenna design was disclosed. This kind of antennas has an angle θ of maximum radiation towards the lower half radiation plane (θ>90°). This angle of maximum radiation will lead to a significant absorption of the radiation energy by the human body. The transmitted signals on the front-end circuit may be interfered by the radiation energy as well. Furthermore, the radiation power on the horizontal plane is normally less than 0 dBi. This will lead to a poor quality of communication on the horizontal plane (θ=90°).

FIG. 1 is a conventional wireless apparatus structure with a monopole antenna element. The wireless apparatus 10 comprises a monopole antenna element 11, a ground plane 12, and an antenna feed-point 13. The distribution of current is shown in FIG. 2. The dashed line shows the magnitude of the current. A positive current 21 flows opposite to a negative current 22 and they have different magnitudes. This results in a shift of radiation patterns of antenna. FIG. 3 shows the radiation patterns of the wireless apparatus shown in FIG. 1. Referring to FIG. 3, the angle θ of maximum radiation of antenna is located at θ=130°. The power gain at θ=90° is less than 0 dBi. They are −7 dBi on the x-z plane and −5 dBi on the y-z plane, respectively. It is obvious that these kinds of radiation patterns and antenna gains shall affect the quality of communication.

SUMMARY OF THE INVENTION

The present invention has been made to overcome the drawbacks of the aforementioned conventional wireless apparatus. It provides a wireless apparatus capable of controlling the radiation patterns of antenna, and resolves the problems caused by shift of radiation patterns of antenna.

The wireless apparatus of the present invention, which is capable of controlling radiation patterns of antenna, comprises an antenna, a ground plane, an antenna feed-point, and at least one slot or slit formed on the ground plane.

In a preferred embodiment of the present invention, the angle θ of maximum radiation of antenna is located at θ<90°. The resulting horizontal power gains of the antenna are greater than 0 dBi on both x-z and y-z plane to control radiation pattern and improve antenna's horizontal gain.

In summary, the wireless apparatus of the present invention has the advantages of simple structure, easy fabrication, and better performance of antenna radiation than the conventional wireless apparatus. The invention can be applied to various kinds of antennas, such as monopole antenna, shorted-monopole antenna, dipole antenna, loop antenna, and planar inverted-F antenna, etc.

The foregoing and other objects, features, aspects and advantages of the present invention will become better understood from a careful reading of a detailed description provided herein below with appropriate reference to the accompanying drawings.

DETAILED DESCRIPTION OF THE PREFERRED EMBODIMENTS

Figure 1:
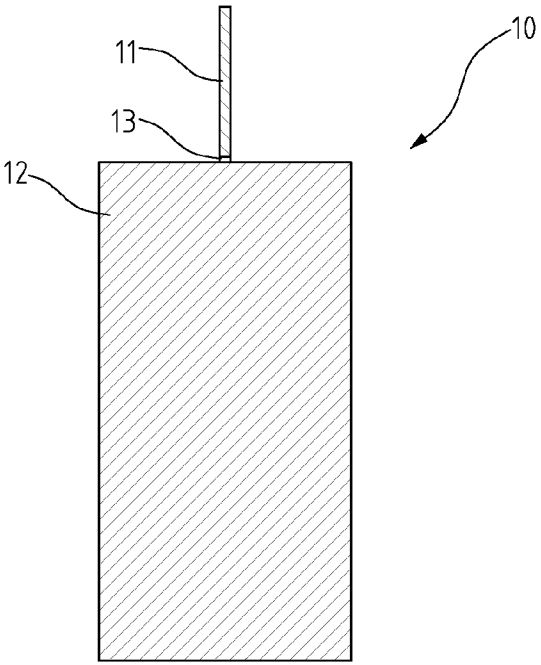
FIG. 1 (Prior Art)
FIG. 1 shows the structure of a conventional wireless apparatus with a monopole antenna element.
Figure 2:
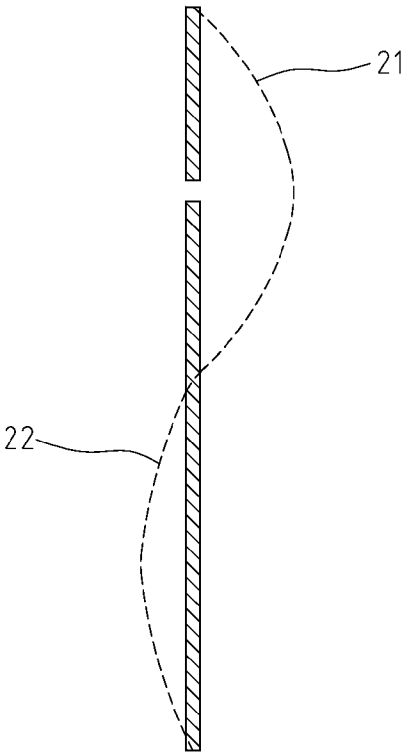
FIG. 2 ( Prior Art )
FIG. 2 shows the current distribution in the monopole antenna shown in FIG. 1.
Figure 3:
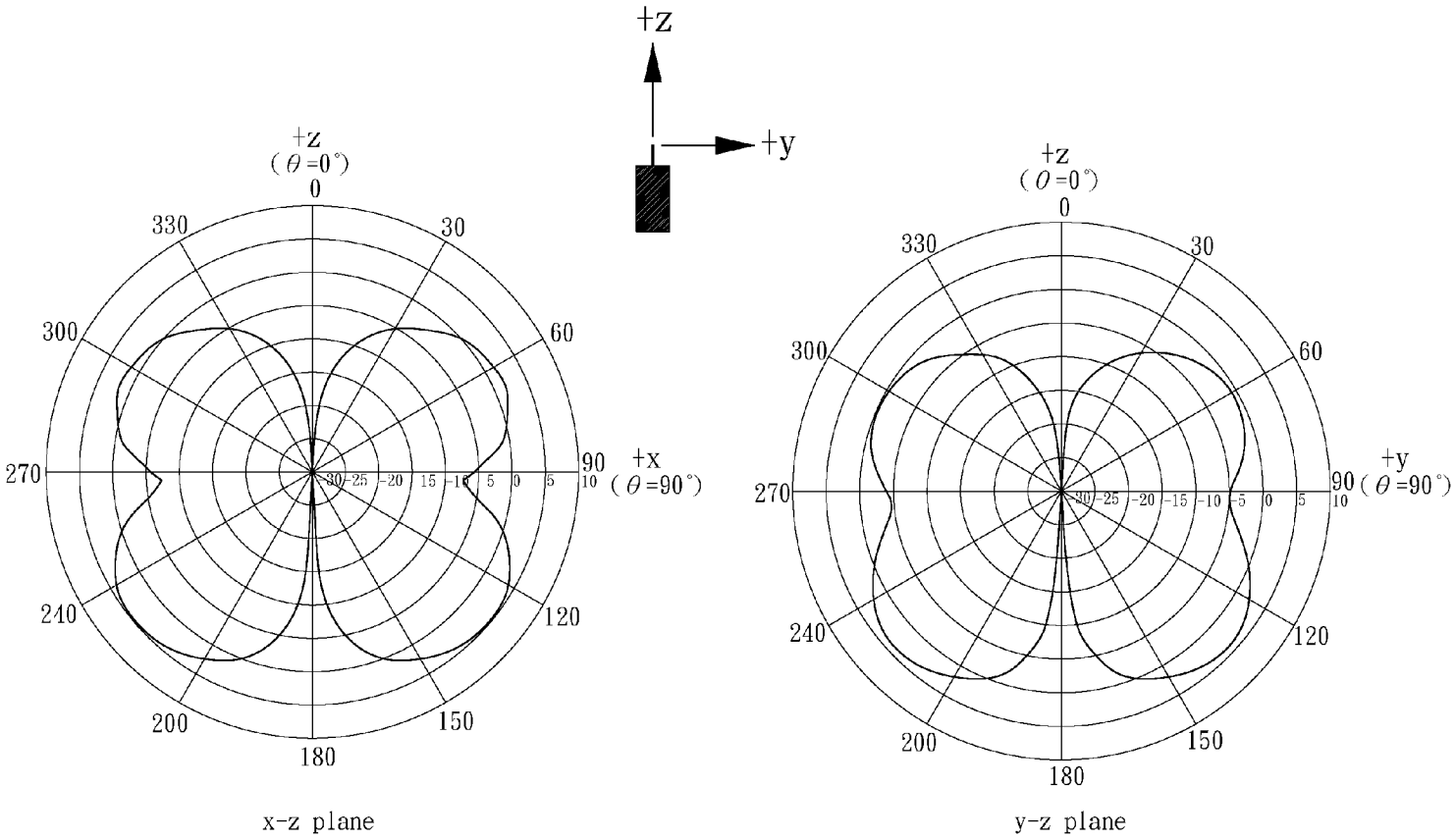
FIG. 3 ( Prior Art )
FIG. 3 shows the radiation patterns of the monopole antenna shown in FIG. 1.
Figure 4:
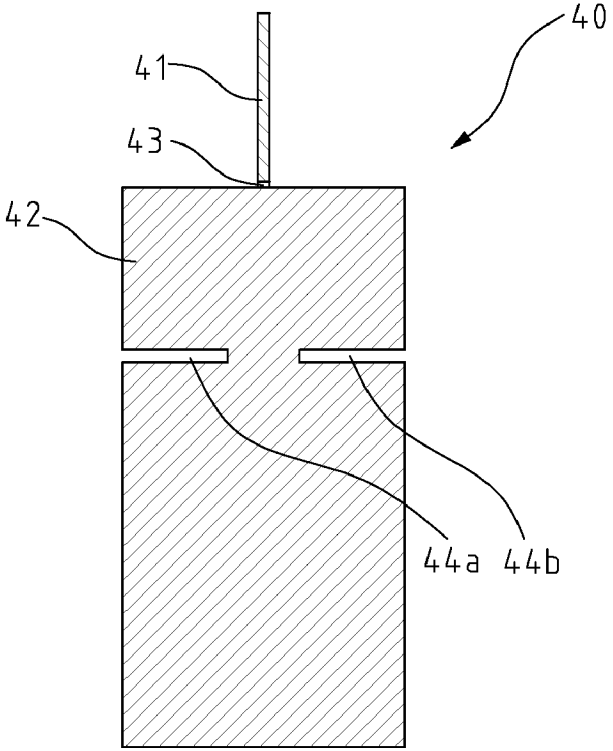
FIG. 4 shows the structure of a wireless apparatus of the first embodiment of the present invention.

FIG. 4 shows the structure of a wireless apparatus of the first embodiment of the present invention. The wireless apparatus 40 comprises an antenna element, a ground plane 42, an antenna feed-point 43, and at least one slot or slit formed on the ground plane 42. Both the antenna element and the ground plane 42 are connected to the antenna feed-point 43. Without loss of generosity, the embodiment containing a monopole antenna element 41 and dual slots or slits 44*a* and 44*b* is adopted as an example to describe the invention. The dual slots or slits 44*a* and 44*b* are formed on the ground plane 42, which are used to suppress the negative current on the ground plane. Therefore, the angle θ of maximum radiation of antenna can be changed from θ>90° to θ<90°. Moreover, the horizontal power gain of antenna can be improved.

Figure 5:
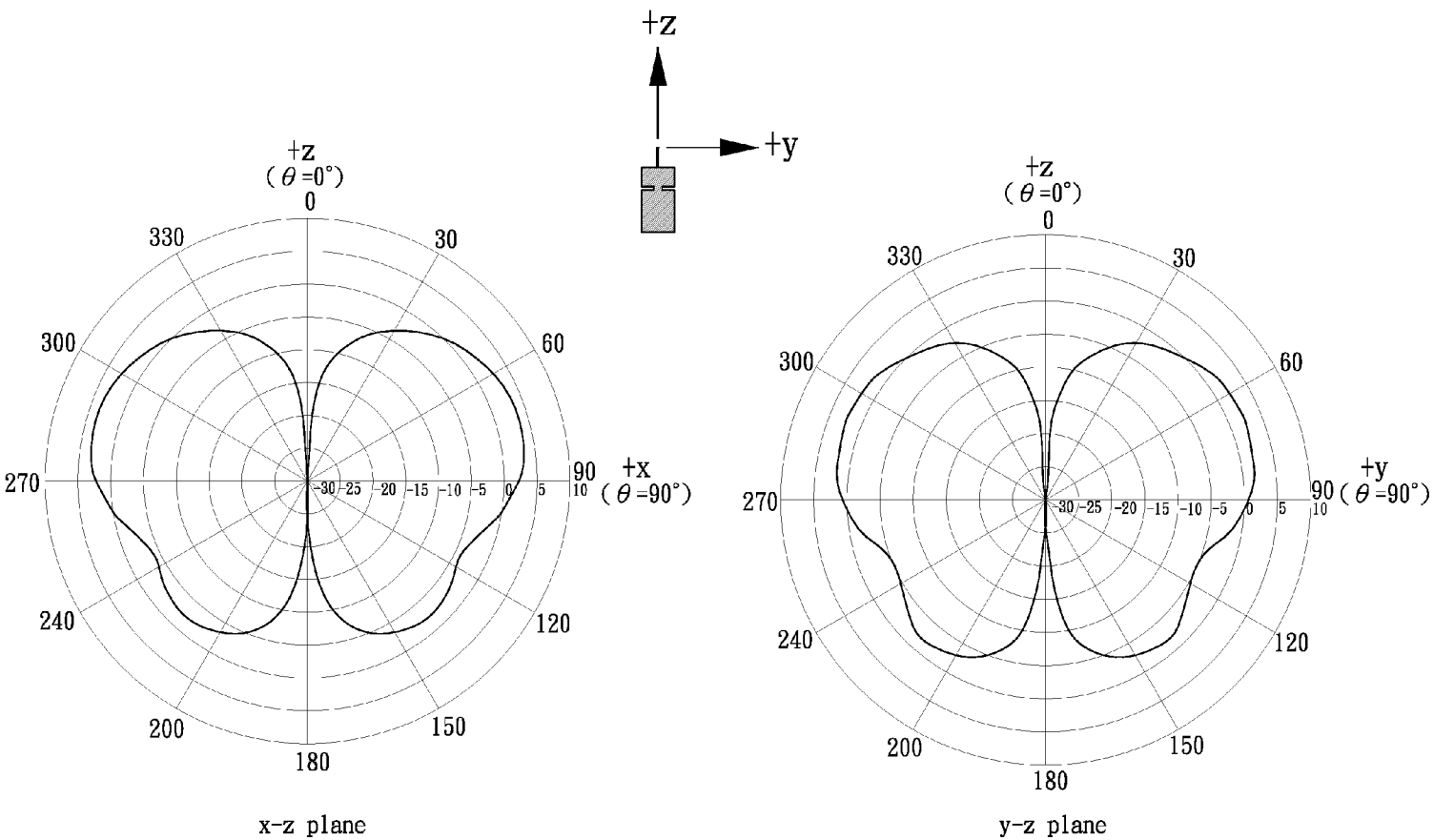
FIG. 5 shows the measured radiation patterns of the first embodiment operated at 2450 MHz according to the present invention.

FIG. 5 shows the measured radiation patterns of the first embodiment operated at 2450 MHz according to the first embodiment of the present invention. The antenna element 41 has a length of 28 mm and a width of 2 mm. The ground plane 42 has a length of 100 mm and a width of 50 mm. The dual slots 44*a* and 44*b* have same length of 24.5 mm and same width of 2 mm. As can be seen from FIG. 5, the angle θ of maximum radiation of antenna is located at about θ=75°. The horizontal power gains on both the x-z plane and the y-z plane are greater than 0 dBi, and are equal to 2 dBi and 1 dBi, respectively. The objectives of changing the angle θ of maximum radiation of antenna from θ>90° to θ<90° and improving horizontal power gain of antenna are achieved.

Figure 6B:
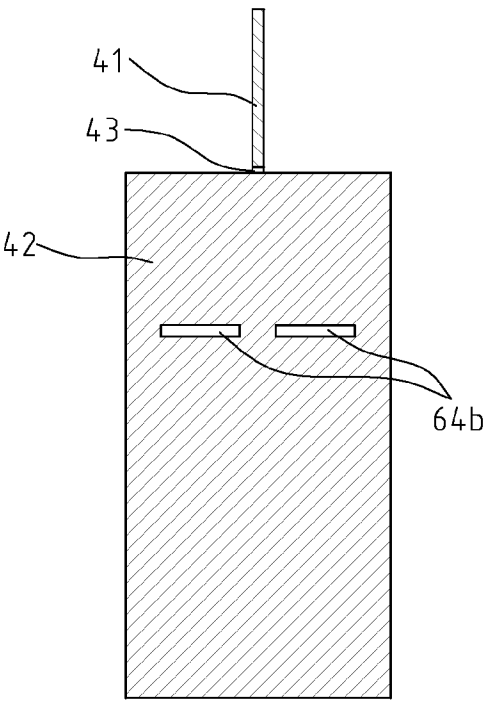
FIG. 6B shows the structure of a ground plane with dual slots or slits according to the present invention.
Figure 6A:
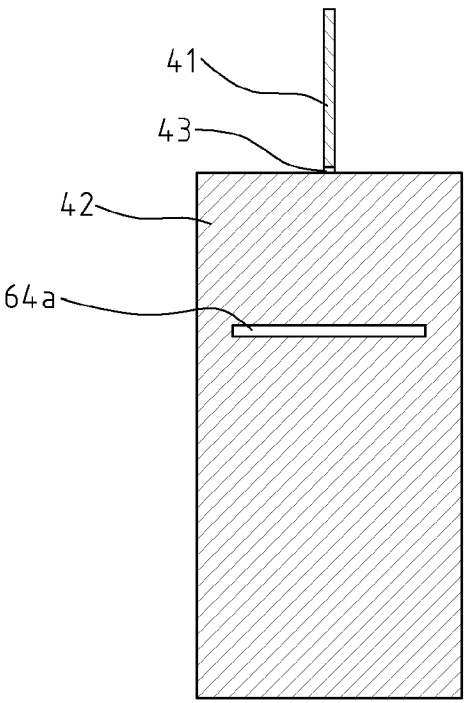
FIG. 6A shows the structure of a ground plane with single slot or slit according to the present invention.
Figure 6C:
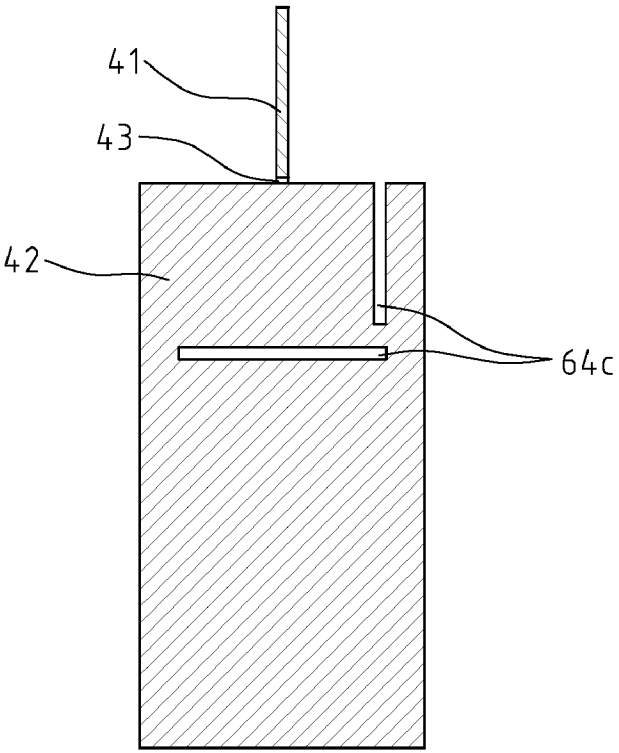
FIG. 6C shows the structure of a ground plane with two slots or slits perpendicular to each other according to the present invention.

According to the present invention, the slots or slits on the ground plane can have various kinds of structures, such as those examples shown in FIGS. 6A, 6B, and 6C. FIG. 6A shows the structure of a ground plane with single slot or slit. FIG. 6B shows the structure of a ground plane with dual slots or slits. FIG. 6C shows the structure of a ground plane with two slots or slits perpendicular to each other. The number and location of the slots or slits on the ground plane are not limited to the examples described above. When the distance between slot or slit and antenna feed-point is shorter than 0.5 times the wave length of antenna's operating frequency, good radiation patterns of antenna can be obtained. The shape of the slot/slit can be a rectangle or circle or oval or polygon, etc.

According to the present invention, the antenna element of the wireless apparatus can have various kinds of structures, such as monopole antenna, shorted-monopole antenna, dipole antenna, loop antenna, and planar inverted-F antenna, etc.

Figure 7B:
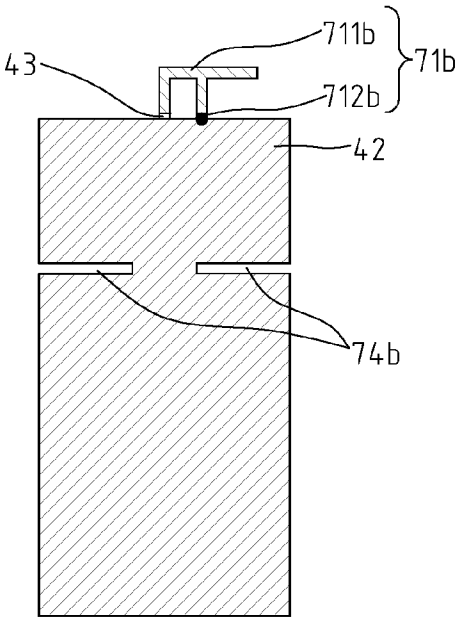
FIG. 7B shows the structure of a wireless apparatus with a shorted-monopole antenna according to the present invention.
Figure 7A:
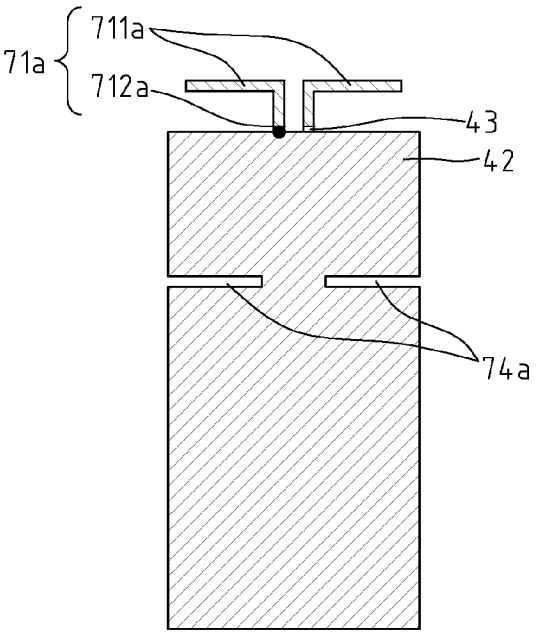
FIG. 7A shows the structure of a wireless apparatus with a dipole antenna according to the present invention.
Figure 7D:
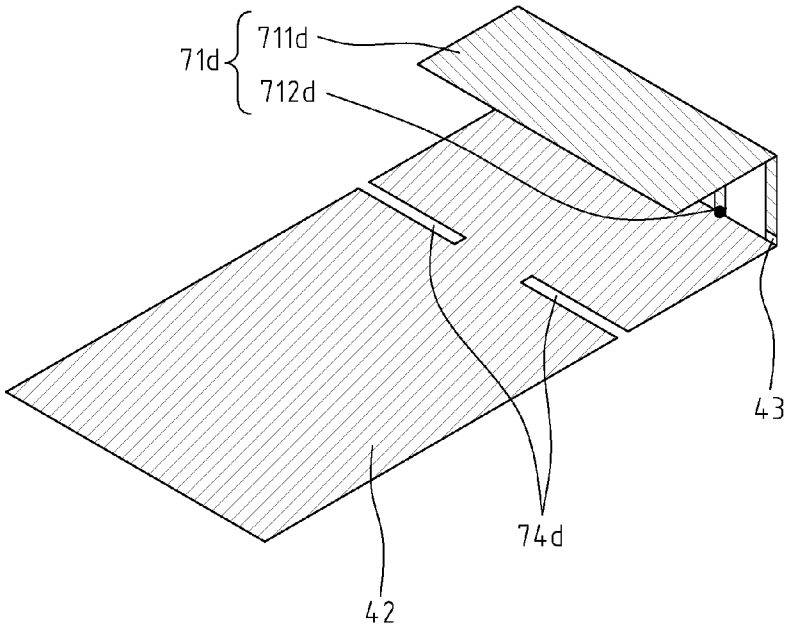
FIG. 7D shows the structure of a wireless apparatus with a planar inverted-F antenna according to the present invention.
Figure 7C:
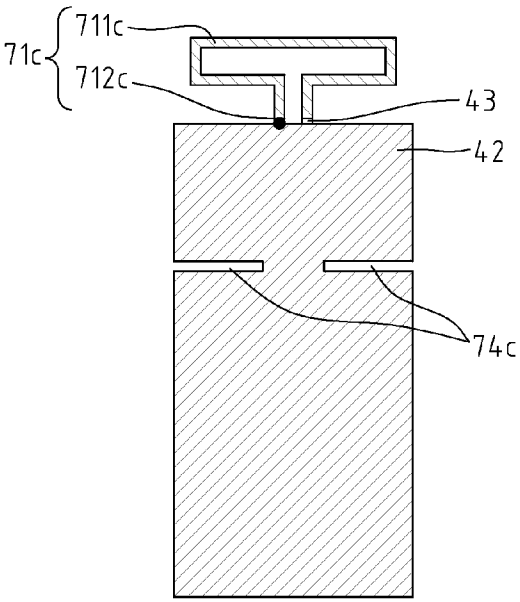
FIG. 7C shows the structure of a wireless apparatus with a loop antenna according to the present invention.

FIG. 7A shows the structure of a wireless apparatus with a dipole antenna according to the present invention. Its antenna element 71*a* comprises a dipole antenna element 711*a* and a connecting point 712*a* used for ground connection to the ground plane 42. FIG. 7B shows the structure of a wireless apparatus with a shorted-monopole antenna according to the present invention. Its antenna element 71*b* comprises a shorted-monopole antenna element 711*b* and a connecting point 712*b* used for ground connection to the ground plane 42. FIG. 7C shows the structure of a wireless apparatus with a loop antenna according to the present invention. Its antenna element 71*c* comprises a loop antenna element 711*c* and a connecting point 712*c* used for ground connection to the ground plane 42. FIG. 7D shows the structure of a wireless apparatus with a planar inverted-F antenna according to the present invention. Its antenna element 71*d* comprises a planar inverted-F antenna element 711*d* and a connecting point 712*d* used for ground connection to the ground plane 42.

In summary, the wireless apparatus of the present invention has the advantages of simple structure, easy fabrication, and better performance of antenna radiation than the conventional wireless apparatus. The invention can be applied to various kinds of antenna systems. Therefore, the present invention has high value of applications in the industry.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A wireless apparatus capable of controlling the radiation patterns of antenna, comprising:

an antenna element having an operating wavelength, said antenna element being without a ground connection point;

a ground plane having a distribution of positive and negative currents;

an antenna feed-point; and at least one ground plane negative current suppressing slot or slit formed on said ground plane for controlling an angle of maximum radiation of said antenna element, wherein said antenna element and said ground plane are connected to said antenna feed-point but said antenna element is not connected to said ground plane.

2. The wireless apparatus capable of controlling the radiation patterns of antenna as claimed in claim 1, wherein the shape of said slot or slit is a rectangle.

3. The wireless apparatus capable of controlling the radiation patterns of antenna as claimed in claim 1, wherein the distance between said antenna feed-point and said slot or slit is less than half of the operating wavelength of said antenna element.

* * * * *